United States Patent [19]

Broussard

[11] 4,366,933

[45] Jan. 4, 1983

[54] APPARATUS FOR FIRE HOSE DEPLOYMENT

[76] Inventor: Kenneth W. Broussard, 6956 Hansen, Groves, Tex. 77619

[21] Appl. No.: 169,664

[22] Filed: Jul. 17, 1980

[51] Int. Cl.[3] ..... B65H 75/34

[52] U.S. Cl. ..... 242/86.1; 242/86.2; 280/47.26; 280/63

[58] Field of Search ..... 242/86.1, 86.2, 86, 242/68.7, 86.5 R, 129, 78.7, 86.52; 414/911; 280/47.26, 47.19, 47.35, 63; 239/199, 198, 195; 137/355.12, 355.17, 355.16, 355.27, 355.28

[56] References Cited

U.S. PATENT DOCUMENTS

| | | | |
|---|---|---|---|
| 972,222 | 10/1910 | Paul | 242/86.1 |
| 1,825,488 | 9/1931 | Tobin | 242/129 X |
| 2,815,180 | 12/1957 | Pratt | 242/86.1 |
| 3,171,430 | 3/1965 | Lovell et al. | 137/355.12 |
| 4,039,157 | 8/1977 | Arriola, Jr. | 242/68.7 X |
| 4,095,706 | 6/1978 | Schwien et al. | 242/86.5 R X |
| 4,174,809 | 11/1979 | Arlemark | 242/86.2 X |
| 4,288,047 | 9/1981 | Berry et al. | 242/86 |

FOREIGN PATENT DOCUMENTS

| | | | |
|---|---|---|---|
| 500346 | 5/1930 | Fed. Rep. of Germany | 242/68.7 |
| 854477 | 4/1940 | France | 280/63 |
| 169181 | 7/1934 | Switzerland | 239/199 |
| 246158 | 12/1946 | Switzerland | 280/63 |
| 1073744 | 6/1967 | United Kingdom | 280/47.26 |

*Primary Examiner*—John M. Jillions

*Attorney, Agent, or Firm*—Gunn, Lee & Jackson

[57] ABSTRACT

Apparatus for deployment of fire hose includes a receptacle for supporting coils of fire hose and for allowing selective, free rotation of the individual fire hose coils during deployment. The receptacle may take the form of a mobile wheeled cart which is adapted to retain a plurality of coils of fire hose in side-by-side relation within a trough-like receptacle. Each of the coils of fire hose is coiled in helical manner from the center thereof, causing the connectors at each extremity of the hose to be positioned in adjacent manner at the outside of the coil. The connectors or adjacent hose sections may be interconnected so as to extend the overall length of the hose being deployed. Hose from each of the coils may be deployed by applying force to either extremity of the hose or simultaneously applying force to both extremities thereof. Upon application of such force, the coil unrolls and becomes oriented in straight line manner extending from the mobile support. The cart may be towed manually by fire-fighting personnel, or may be towed by means of small personnel carts or trucks to enable the hose to be deployed in congested areas that are inaccessible by conventional fire-fighting equipment.

8 Claims, 3 Drawing Figures

FIG.1
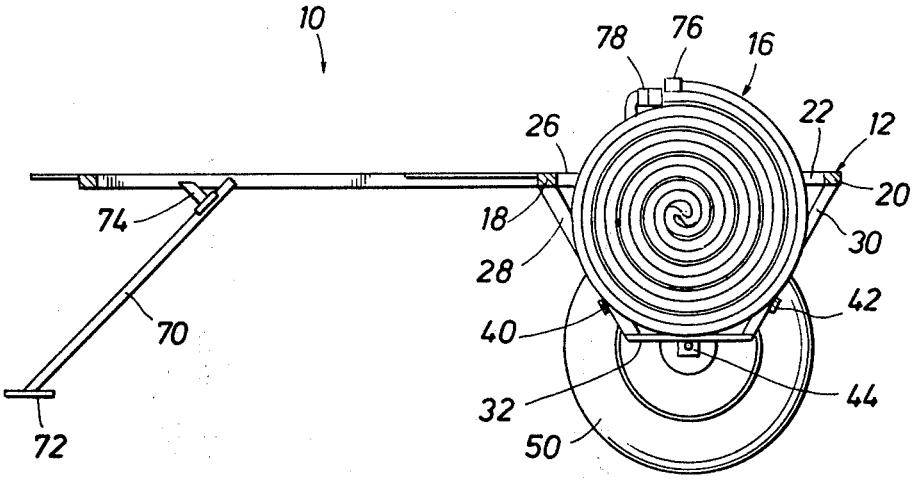
FIG. 2
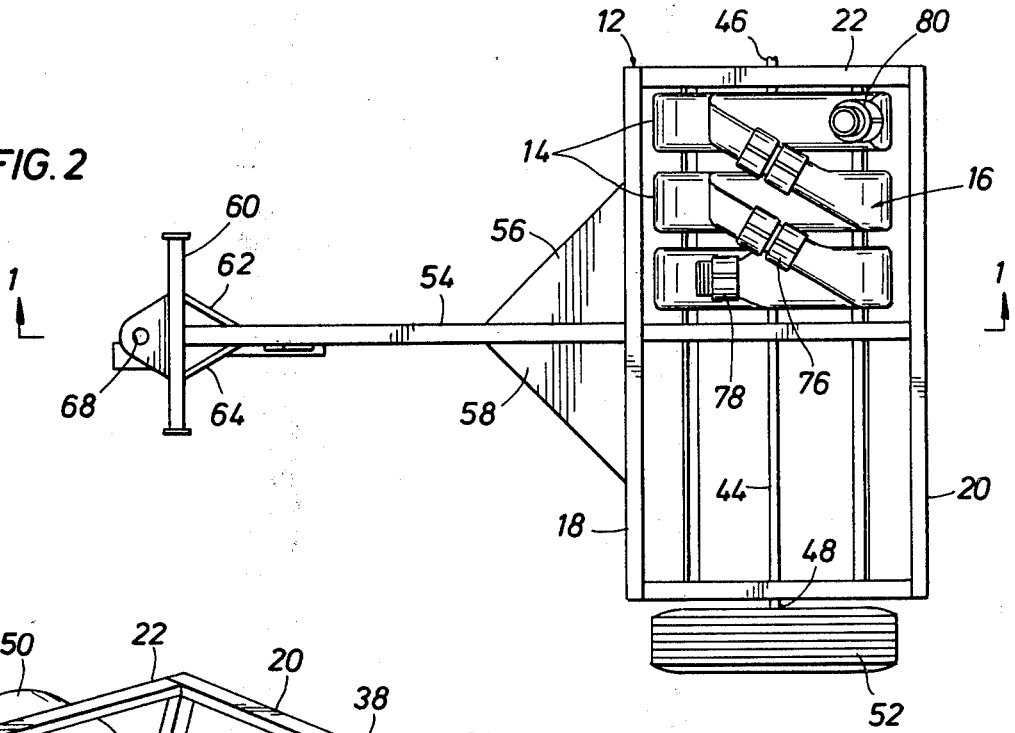
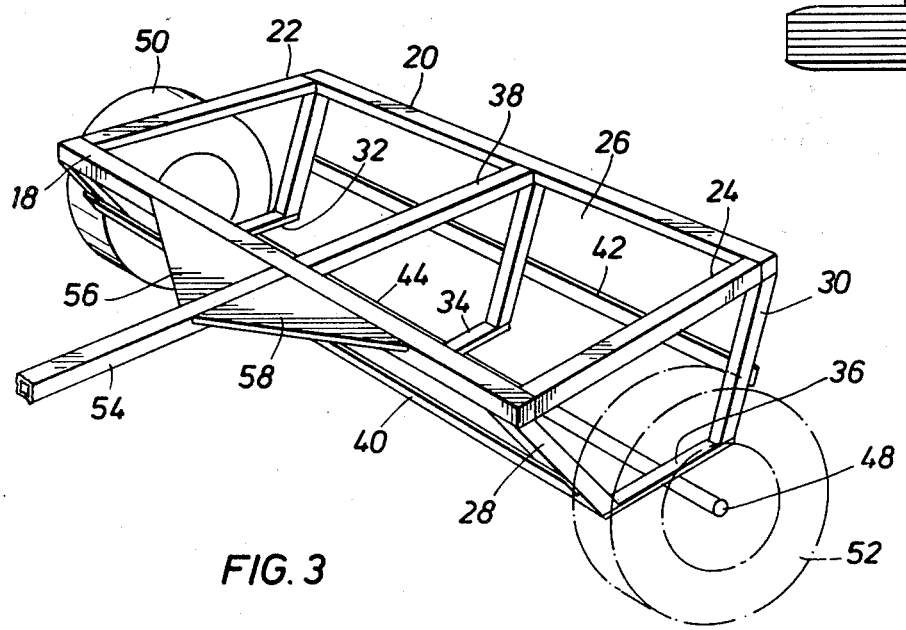
FIG. 3

APPARATUS FOR FIRE HOSE DEPLOYMENT

FIELD OF THE INVENTION

This invention relates generally to fire fighting equipment and more specifically relates to apparatus for achieving efficient and rapid deployment of fire hose, which apparatus is especially adapted for manual or power energized handling and permits ready access of fire fighting equipment into congested areas that are relatively inaccessible by conventional fire fighting equipment.

BACKGROUND OF THE INVENTION

In many processing plants, manufacturing plants and the like, there is a need to provide readily accessible fire fighting equipment that can be brought into operation on extremely short notice. For example, in refineries for petroleum products, there is typically found a maze of pipework creating a flow system that enables the handling of products being refined during the various phases of the refining process. This maze of pipework typically defines quite congested areas within which operating personnel work. In the event a fire should develop in a congested area of this nature, it is unlikely that conventional fire fighting equipment will be capable of quickly reaching the fire because large fire trucks are incapable of being positioned in close proximity to the fire. It is typically necessary, therefore, to extend fire hose a considerable distance from fire truckes to the congested area where the fire may be located and in doing so, precious fire fighting time is lost. Moreover, the pressure loss that occurs through long extensions of fire hose can cause diminished delivery of fire fighting fluid such as water or foam at the site of the fire. It is desirable, therefore, to provide means for achieving rapid deployment of fire hose even in congested areas and it is also desirable to provide a fire hose deployment system that may be handled manually as well as by means of power energized equipment. It is further desirable to provide a hose deployment system having the capability of passing through rather congested areas while at the same time rapidly deploying hose in such manner that the hose can be readily connected to water or foam supply systems, thus enabling the fire to be attended as soon as possible. This enables the fire to be contained and keeps it from spreading to other processing equipment where the fire may take on a more major character.

In the past, fire hose deployment systems have been developed wherein the fire hose is wound about a reel. The reel is either mobile by means of wheels or is fixed. The fire hose is deployed simply by pulling on the free end, thus causing the reel to rotate. To reach the fire, it is necessary that the hose that is unreeled be dragged along the ground, thus possibly damaging the hose or causing it to become kinked. Moreover, personnel are typically required to pull the hose to the full extent of its length requiring considerable physical exertion. Where the hose is mounted on mobile hose reels, it must always be unwound beginning with a particular end, i. e. the nozzle end or connection end. It may be necessary, therefore, to begin laying the hose at the fire or away from the fire, depending on the manner by which the hose is wound. Hose deployment is not capable of being accomplished selectively depending upon the location of the reeled hose, the fire or the fluid supply. It is desirable therefore to provide a system for fire hose deployment which provides a wide range of selectivity or flexibility to better accommodate the various fire fighting situations that may occur.

In congested product processing areas, such as in refineries for petroleum products where extremely flammable products are handled, it is obvious that a fire can be ignited at any one of a number of locations. By providing a fire hose deployment system whereby hose can be paid out from the fire to a fluid supply or from a fluid supply to the fire, the fire hose can be handled in the most practical manner to achieve rapid deployment thereof and thus rapid application of controlling fluid to the fire. Further, it is desirable to provide a fire hose deployment system wherein fire hose may be deployed in both directions from a storage facility toward the fire and toward a fluid supply connector, thus minimizing the time necessary to bridge the distance between the fluid supply connector and the fire. Of course, it is necessary to dispense the fire hose in a kink free condition, thereby preventing kinks from interfering with fluid flow when the fire hose has been placed in service.

SUMMARY OF THE INVENTION

It is therefore a primary feature of the present invention to provide a novel deployment system for fire hose wherein fire hose is rapidly deployed in kink free manner even under circumstances where the space for access to the fire is limited.

Another feature of this invention involves the provision of a novel fire hose deployment system wherein hose may be selectively deployed from a fire to hose connection apparatus, from the connection apparatus to the fire or from an intermediate position toward both the fire and the connection apparatus depending upon the locations of the hose, fire and connection apparatus.

It is also a feature of the present invention to provide novel apparatus for fire hose deployment wherein the apparatus may be handled manually or by small towing equipment as desired, in order to achieve efficient and effective deployment of the fire hose.

It is also a feature of this invention to provide novel apparatus for deployment of fire hose wherein small portable transporting apparatus is provided to enable the fire hose to be transported during handling by means of a small cart that may be towed by small personnel service vehicles, small trucks or manually to enable the fire hose to be deployed effectively.

Among the several features of this invention is contemplated the provision of novel apparatus for achieving deployment of fire hose wherein hose is dispensed from a helical coil wound about its own center, thus enabling either extremity of the hose to be moved or both extremities moved simultaneously, depending upon the character of hose movement that is required to establish hose interconnection between a fluid supply connector and the fire.

Other and further objects, advantages and features of the invention will become obvious to one skilled in the art upon an understanding of the illustrative embodiment about to be described, and various advantages, not referred to herein, will occur to one skilled in the art upon employment of the invention in practice.

SUMMARY OF THE INVENTION

Briefly, the present invention concerns the provision of apparatus and a method for achieving deployment of fire hose. The hose is wound in a helical coil about the center of a length of fire hose wherein the connectors at each extremity of the hose are positioned at the outside of the coil. One or preferably a plurality of coils of fire hose coiled in this manner are positioned in side-by-side relation within a hose deployment receptacle which may, if desired, be provided on a mobile cart. The connectors of adjacent coils of fire hose that are helically wound in this manner may be interconnected so as to establish connection between several lengths of fire hose contained within the receptacle or mobile cart. To achieve deployment of the fire hose, a restraining force may be provided at either of the free extremities of the coils of hose so as to restrain one end of the hose at the site of use at the fire or at the site of the connector. The mobile cart is then moved toward another desired location, paying out hose as it moves, thus transporting the opposite hose extremity and connector to its selected site for use. In the alternative, the hose receptacle or trough may be maintained in a stationary or substantially stationary position and the hose may be manually paid out from either selected extremity thereof simply by applying sufficient force thereto to achieve rotation of the coil of hose within the receptacle. As a further alternative, the receptacle or mobile cart may be maintained in substantially stationary relation and both free extremities of the hose may be paid out simultaneously in opposite directions toward the sites of connection to a fluid supply and the fire.

The hose receptacle is provided in the form of a trough that may be defined by a framework in order to maintain the trough as light-weight and portable as possible. The trough is typically defined by sloping side portions that converge downwardly and with opposed end portions that are interconnected with the side portions. The framework also includes a bottom portion that interconnects the side portions and end portions of the framework structure. Hose coil support bars may be provided in properly oriented manner by the respective side portions and bottom portion in order to provide adequate support for coils of fire hose both at the full size of the coil and at the diminished size thereof that occurs during deployment. The bottom support bar, if desired, may be formed by the axle of a mobile cart having wheels supported at each end of the axle. Under circumstances where the receptacle is in the form of a mobile cart, a tongue is provided for the cart which enables it to be towed manually or towed by power apparatus such as a small personnel cart, a small vehicle, etc. The cart is of sufficiently light-weight character that it is easily towed by personnel, thus enabling the hose to be rapidly and efficiently deployed in congested areas even when towing equipment is incapable of entering such congested areas.

BRIEF DESCRIPTION OF THE DRAWINGS

In order that the manner in which the above-recited advantages and objects of the invention are attained, as well as others, which will become apparent, can be understood in detail, more particular description of the invention, briefly summarized above, may be had by reference to the specific embodiment thereof that is illustrated in the appended drawings, which drawings form a part of this specification. It is to be understood, however, that the appended drawings illustrate only a typical embodiment of the invention and therefore are not to be considered limiting of its scope, for the invention may admit to other equally effective embodiments.

In the drawings:

FIG. 1 is a side elevational view of fire hose deployment apparatus constructed in accordance with the present invention and representing a preferred embodiment of the invention.

FIG. 2 is plan view of the fire hose deployment apparatus of FIG. 1, showing three coils of interconnected fire hose positioned in one of the two compartments thereof.

FIG. 3 is an isometric view of the fire hose deployment apparatus of FIGS. 1 and 2, illustrating the framework structure of the apparatus in detail.

DETAILED DESCRIPTION OF PREFERRED EMBODIMENT

Referring now to the drawings and first to FIG. 1, apparatus for deployment of fire hose is illustrated generally at 10 and comprises a receptacle shown generally at 12 within which may be maintained at least one and preferably a plurality of coils 14 of fire hose illustrated generally at 16.

Although the receptacle 12 may take any one of a number of convenient forms, for purposes of discussion herein, the receptacle is shown to be in the form of a framework structure having upper side members 18 and 20 that are interconnected with end members 22 and 24 in such manner as to define a generally rectangular frame forming at least one upwardly directed opening 26. A plurality of pairs of downwardly converging side members 28 and 30 are provided and are interconnected at the upper extremities thereof to the rectangular frame defined by side members 18 and 20 and end members 22 and 24. Bottom support elements 32, 34 and 36 are interconnected with respective pairs of the side members 28 and 30 and cooperate to define a bottom structure for the receptacle or trough within which the fire hose is received. A transverse intermediate member may be provided as shown at 38 which divides the receptacle or trough into a pair of compartments either or both of which may be filled with interconnected coil sections of fire hose in the manner illustrated in FIGS. 1 and 2. The intermediate member 38 divides the opening 26 of the rectangular frame into a pair of openings.

To provide adequate support for the coils of fire hose within the trough-like receptacle structure, elongated support members 40 and 42 are interconnected intermediate the extremities of the side members 28 and 30 and are positioned in substantially parallel relationship with side members 18 and 20. A bottom structural support is provided by an elongated member 44 which is interconnected with the central portions of the bottom members 32, 34 and 36. Under circumstances where the receptacle is provided in the form of a mobile cart structure, the bottom support member 44 may be defined by an axle member having axle extremities 46 and 48 that provide support for wheels 50 and 52. To further provide for the mobile nature of the receptacle 12, a tongue structure 54 is interconnected with the side member 18 and is reinforced by means of fillets 56 and 58 that are of triangular form and are interconnected both with the tongue and with the side member 18. At the free end of the tongue, there is provided a transverse handle structure 60 that is strengthened with respect to its connection with the tongue by means of structural elements 62 and 64 that are connected in any suitable manner to both the tongue and handle. A hitch element 66 is interconnected with the handle structure and is formed to define a hitch aperture 68 through which a suitable hitch pin may be positioned in order to interconnect the tongue 54 in towed relation with respect to a trailer hitch provided on a suitable vehicle. Because of the small nature of the cart, it may be towed manually by personnel grasping the handle 60 or it may be towed by small service vehicles such as motorized personnel carriers, small tractors, pick-up trucks, etc.

A strut element 70 is interconnected with the tongue 54 and is provided with a support pad 72 at the lower extremity thereof. The strut 70 maintains the tongue 54 in proper position to be readily and efficiently grasped by workmen for manual towing operations or for adequate positioning at the proper height for connection to the trailer hitch structure of appropriate towing vehicles. The strut 70 is supported by means of a transverse structural brace 74.

Although the receptacle 12 has been illustrated particularly in its form as a mobile cart for achieving deployment of fire hose, it is not intended to limit the invention to utilization in conjunction with a mobile cart structure. For example, the receptacle 12 may be of stationary nature, such as having one extremity thereof mounted on a wall support and with one extremity of the fire hose maintained in interconnected relation within the trough-like receptacle. The fire hose may be deployed simply by grasping the connector at the free extremity of the fire hose and pulling it to the fire. As the coil of fire hose unrolls, the extremity thereof that is connected to fluid supply structure forms a loop of varying size. After the central portion of the hose is reached by the uncoiling operation, the large loop then is straightened out until the length of hose is fully deployed. The resulting length of deployed fire hose is of linear nature and is deployed in straight, kink-free manner and may be put into operation as soon as fully deployed. Also, if desired, the receptacle 12 may be formed with side and bottom portions defined by wall members rather than by means of an open framework, as shown.

As illustrated in the drawings, the coils 14 of fire hose 16 rest within the receptacle with the bottom portion thereof in supported contact with the bottom support member or axle 44 and with side portions thereof in engagement with the side support elements 40 and 42. The bottom support element, together with the side support elements, form a cradle to properly support the coils of fire hose in side-by-side relation with the axes thereof positioned in substantially coaxial relation and in substantially parallel relation with the bottom support member or axle 44. Each of the coils of fire hose is wound by first locating the center of the hose and by then winding the hose helically about the center thereof until the hose is fully wound. When fully wound, the male and female connectors 76 and 78 thereof are positioned at the outer portions of the respective coils, as shown in FIG. 1. As shown in FIG. 2, the connectors of adjacent ones of the coils 14 may be interconnected thereby allowing the plurality of coils to be coextensive when the hose is fully deployed thereby preventing the necessity for making a connection between the hose sections. Also, if desired, the various hose coils 14 may be simultaneously deployed simply by preventing movement of one of the extremities thereof and by moving the hose deployment cart or receptacle in linear manner. The simultaneously deployed hoses may then be interconnected with a fluid supply manifold and may be utilized simultaneously to dispense fluid on the fire.

Fire hoses are typically provided in two conventional sizes in conformance with commercial standards. The hose deployment cart or receptacle is of sufficient size to contain a desired number of hose sections in conformance with commercial standards. For example, one of the compartments of the hose receptacle is of a size to contain three fifty-foot sections of two and one-half inch collapsible hose such as shown in FIG. 2. The compartments are also of a size to contain five fifty-foot lengths of one and one-half inch collapsible hose, or a total hose capacity of five hundred feet of one and one-half inch hose total. Obviously, the compartments may be of differing size, depending upon the size and capacity requirements that are desired.

When deploying a single coil of hose arranged in the manner illustrated in FIG. 1, the hose connector 76 may be restrained at a fluid supply device such as a fire hydrant or foam supply facility. The mobile cart is then moved toward the direction of the fire and such movement causes uncoiling of the coiled hose. The opposite extremity of the hose, defined by connector 78, is caused to remain substantially motionless on the cart as the hose is paid out. The paid out hose from extremity 76 is paid out in a straight line behind the moving cart while that portion of the hose extending from connector 78 is paid out in the form of an enlarging loop as the cart moves toward its destination. After paying out twenty-five feet of hose from the extremity 76, the center of a fifty foot hose section will be reached and the loop of hose that has been developed from the center point to the connector 78 will then begin to straighten out as the cart continues to move. After another fifty feet of movement of the cart, the hose coil is completely deployed in a straight line and may be utilized in conventional manner. Deployment of three hundred feet of two and one-half inch collapsible hose can be readily accomplished in a few seconds time.

Under circumstances where the coils 14 of the hose 16 are interconnected as shown in FIG. 2, the hose may be deployed simply by restraining the hose coupling 80 at the site of use thereof while at the same time moving the mobile cart and the coils of hose supported thereby toward the desired destination. As this movement occurs, the first one of the coils 14 interconnected to coupling 80 will begin to rotate, thus causing the hose interconnected with coupling 80 to be paid out in the manner described above in connection with FIG. 1. The other interconnected coils will remain motionless within the receptacle while the first coil is being uncoiled during deployment. Here again, the first portion of the coil is laid out in straight line manner while the terminal portion forms a large loop as the uncoiling operation continues. After this loop has become straightened out by continuing cart movement in the manner described above in connection with FIG. 1, the coupled hose couplings will then cause the next coiled hose to begin uncoiling movement in the same manner. The uncoiling operation will continue in this manner until the last of the coils of hose has been completely uncoiled or until the cart ceases its linear movement.

If it is desired to deploy a single coil of fire hose coiled in this manner, personnel will grasp respective couplings 76 and 78 and move them in opposite directions while maintaining the cart in substantially stationary manner. One of the couplings, such as shown at 76, may be transported to a hydrant or other fluid supply facility while the other extremity is transported in like manner toward the fire.

In view of the foregoing it is respectfully submitted that I have provided novel fire hose deployment apparatus that is capable of accomplishing all of the features hereinabove set forth and which provides an effective system for firefighting, especially in congested areas. Having thus described my invention in detail,

I claim:

1. Mobile apparatus for storage and deployment of fire hose, comprising:

(a) an elongated axle having wheels mounted at each extremity thereof;

(b) a plurality of bottom support bars being secured intermediate the extremities thereof to said axle and oriented in transverse relation with said axle;

(c) a plurality of side bars extending upwardly from the extremities of said bottom support bars and being oriented in upwardly diverging pairs;

(d) a pair of upper side bar members being secured to the upper extremities of said side bars;

(e) a pair of end members connected to the extremities of said upper side bar members and cooperating therewith to define a generally rectangular upper frame;

(f) elongated support members being secured intermediate the extremities of said side bars and extending in generally parallel relation with said axle, said support members and said axle forming support means for coils of collapsed fire hose with the axis of rotation thereof being oriented in generally parallel relation with said axle; and (g) an elongated tongue element extending from one of said upper side members.

2. Mobile apparatus as recited in claim 1, wherein said axle, support members and upper side members define a trough-like framework for supporting a plurality of coils of said fire hose and permitting free rotation of said coils of fire hose during deployment thereof.

3. Mobile apparatus as recited in claim 1, wherein: intermediate bar means divides said trough-like framework into a plurality of compartments with the lower hose supporting portion of each compartment being defined by said axle and said side members.

4. Mobile apparatus as recited in claim 3, wherein: said intermediate bar means is positioned in coextensive relation with said tongue and transmits tongue force to the other of said upper side members.

5. Mobile apparatus as recited in claim 1, wherein: manual handle means and vehicle tow hitch means is provided on said tongue to permit selective manual and vehicle powered movement of said apparatus during fire hose deployment.

6. Mobile apparatus as recited in claim 1, wherein: said apparatus is of sufficiently light weight construction and of restricted dimension as to permit manual movement thereof through restricted passageways.

7. Mobile apparatus as recited in claim 1, wherein: tongue support means is secured to said tongue and engages the ground to permit substantially horizontal orientation of said tongue in the free standing condition thereof.

8. Mobile apparatus as recited in claim 1, wherein: structural means interconnects said tongue and said one upper side bar member on each side of said tongue and provides distribution of tongue force to said one upper side bar member.

* * * * *